US007409911B2

(12) United States Patent
Tiernan et al.

(10) Patent No.: US 7,409,911 B2
(45) Date of Patent: Aug. 12, 2008

(54) PROPELLANT FOR FRACTURING WELLS

(75) Inventors: John P. Tiernan, Newnan, GA (US); Richard S. Passamaneck, Golden, CO (US)

(73) Assignee: Propellant Fracturing & Stimulation, LLC, Peachtree City, GA (US)

( * ) Notice: Subject to any disclaimer, the term of this patent is extended or adjusted under 35 U.S.C. 154(b) by 221 days.

(21) Appl. No.: 11/221,634

(22) Filed: Sep. 8, 2005

(65) Prior Publication Data

US 2006/0048664 A1 Mar. 9, 2006

Related U.S. Application Data

(60) Provisional application No. 60/607,929, filed on Sep. 8, 2004.

(51) Int. Cl.
*F42D 1/04* (2006.01)
*E21B 43/26* (2006.01)

(52) U.S. Cl. ..... 102/322; 102/332; 102/275.6; 102/289; 166/271; 166/308.1

(58) Field of Classification Search ..... 102/332, 102/314, 322, 282, 283, 285, 286, 289, 292, 102/275.1, 275.6, 275.8; 89/1.15; 149/2; 166/299, 308.1, 55.1, 177.5, 297, 177.1, 166/271

See application file for complete search history.

(56) References Cited

U.S. PATENT DOCUMENTS 2,361,622 A * 10/1944 Goulet ..... 102/322
3,244,099 A * 4/1966 Lang et al. ..... 181/116
3,349,705 A * 10/1967 Wilson ..... 102/314
3,630,284 A * 12/1971 Fast et al. ..... 166/299
4,023,494 A * 5/1977 Barton et al. ..... 102/314
4,282,812 A * 8/1981 Forgey et al. ..... 102/318
4,284,006 A * 8/1981 Davis ..... 102/317
4,329,925 A 5/1982 Hane et al.
4,485,741 A * 12/1984 Moore et al. ..... 102/331
4,633,951 A 1/1987 Hill et al.
4,683,943 A 8/1987 Hill et al.
4,716,832 A * 1/1988 Sumner ..... 102/275.6
4,718,493 A 1/1988 Hill et al.
4,798,244 A 1/1989 Trost
4,823,876 A 4/1989 Mohaupt
4,976,318 A 12/1990 Mohaupt
5,005,641 A 4/1991 Mohaupt
5,295,545 A 3/1994 Passamaneck
5,308,149 A 5/1994 Watson et al.
5,765,923 A 6/1998 Watson et al.
6,006,671 A * 12/1999 Yunan ..... 102/275.11
6,508,176 B1 * 1/2003 Badger et al. ..... 102/275.7
6,732,799 B2 * 5/2004 Challacombe ..... 166/299
2003/0155112 A1 * 8/2003 Tiernan et al. ..... 166/63

* cited by examiner

*Primary Examiner*—James S Bergin
(74) *Attorney, Agent, or Firm*—Dorr, Carson & Birney, P.C.

(57) ABSTRACT

An apparatus for fracturing wells employs a propellant charge and an ignition cord wrapped around the outer surface of the propellant charge to rapidly ignite the outer surface of the propellant charge.

5 Claims, 4 Drawing Sheets

Fig. 3
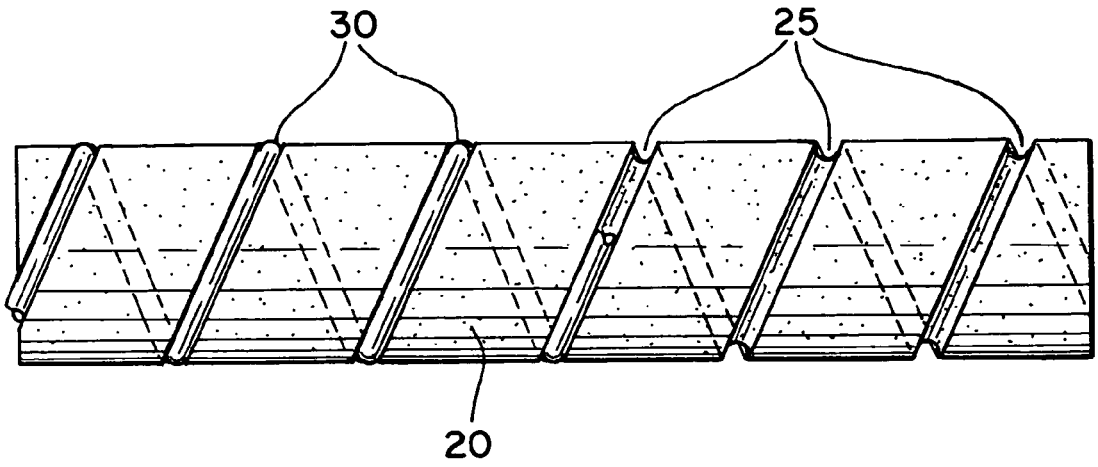
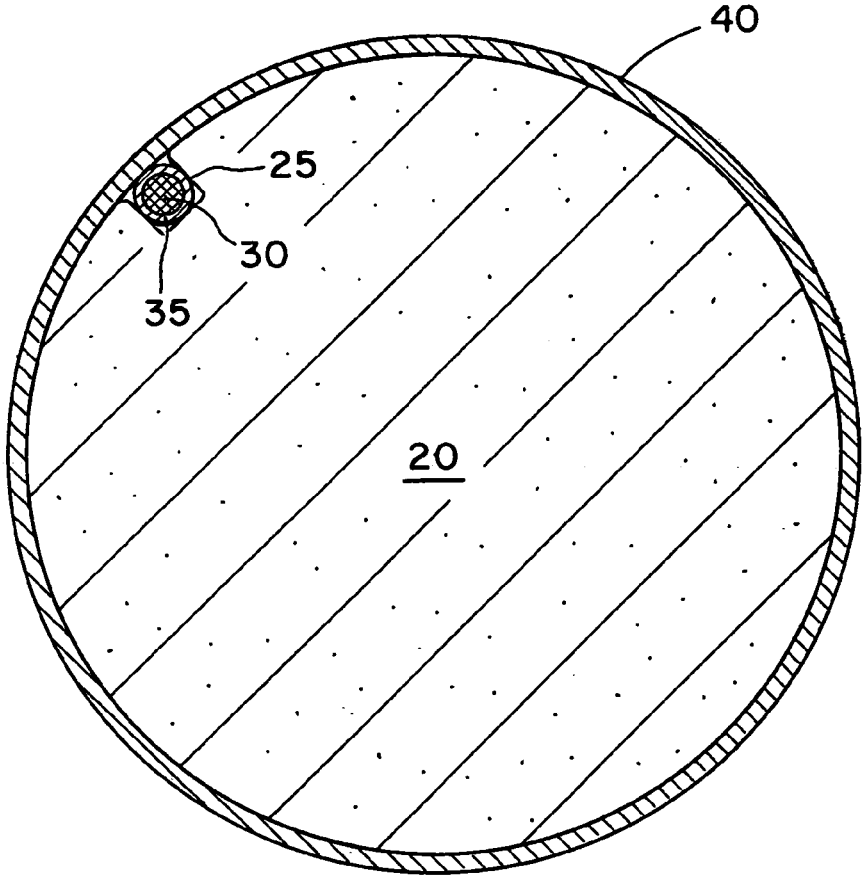
Fig. 4

Fig. 5
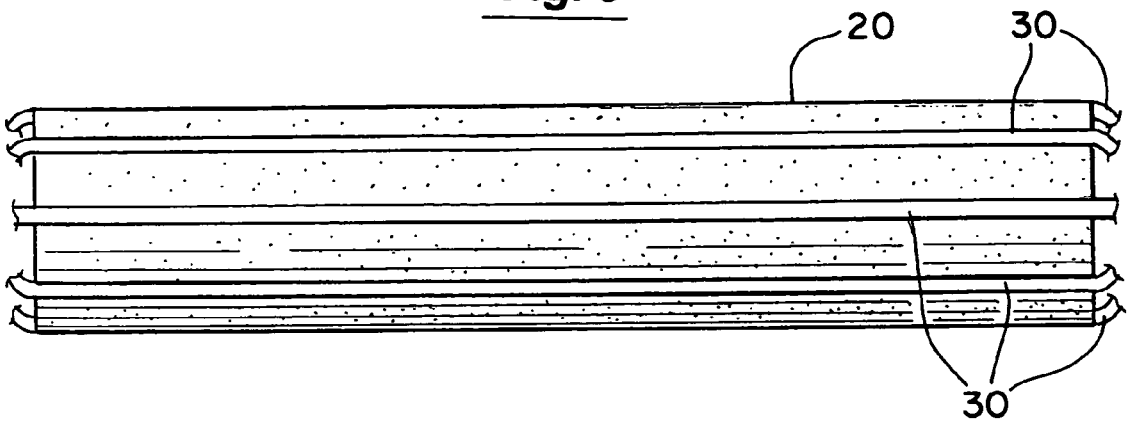
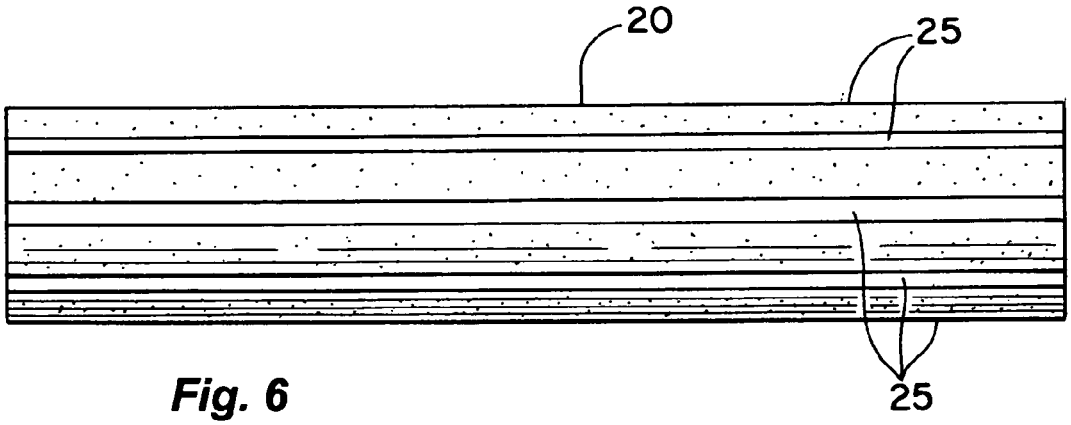
Fig. 6
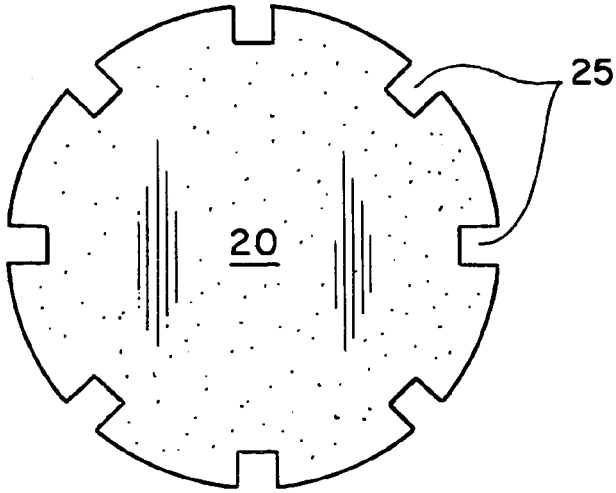
Fig. 7

PROPELLANT FOR FRACTURING WELLS

RELATED APPLICATION

The present application is based on and claims priority to the Applicants' U.S. Provisional Patent Application 60/607,929, entitled "Propellant for Fracturing Wells," filed on Sep. 8, 2004.

BACKGROUND OF THE INVENTION

1. Field of the Invention

The present invention relates generally to the field of well fracturing. More specifically, the present invention discloses a propellant assembly for fracturing wells.

2. Statement of the Problem

Propellant charges have been used for many years to create fractures in oil, gas and water formations surrounding a well. FIG. 1 is a cross-section diagram of a well 10 with a packer 12 and a series of propellant charges 20. The propellant charges 20 are ignited to rapidly generate combustion gases that create sufficient pressure within the well bore to generate fractures in the surrounding strata.

In order to achieve proper pressure loading rates and adequate minimum pressures for sustained periods of time sufficient to extend fractures in the surrounding formations using gas-generating propellants, it is necessary that a sufficient surface area of propellant be burning to generate the volume of gas required to extend such fractures, as gas generation is a function of the surface area of the propellant burning at any given time. If ignition of the propellant is limited to small areas of the outer surface of the propellant, then the flame from the initial burning area of the propellant must spread across the face of the propellant to ignite the remaining surface area. This flame spread rate is a key limiting factor to achieving proper pressure loading rates and adequate minimum pressures for fracture propagation in the surrounding formations. If the flame spread from a localized ignition point is too slow, then the burning surface area at any given point in time will be limited, and the overall time that the propellant burns to completion may have to be extended sufficiently to compensate for the reduced amount of time that pressures exceed the minimum required fracture extension pressure, resulting in a longer but less efficient propellant burn.

In addition, the propellant burn should be predictable and reproducible for the purpose of accurately modeling the fracturing process. It is difficult to accurately model a propellant burn unless the entire exposed surface of the propellant is ignited almost simultaneously. Modeling of propellants has been contemplated in the past, but with the assumption that ignition of the propellant surface over the entire exposed area of the propellant is simultaneous. Practically speaking, such simultaneous ignition is difficult to achieve.

The problem is further complicated by the following. When propellants are submerged in well fluids such as water (or water and KCl), flame spread rates tend to decrease. In addition, certain chemical coverings that are used as surface coatings on propellants to prevent leaching of the propellant fuel oxidizers into the surrounding well fluids also tend to inhibit the flame spread rate, thus exacerbating the problem. When such coatings are not applied to the surface of the propellant, sufficient leaching of the fuel oxidizer takes place over relatively short periods of time (i.e., 1 hour) to result not only in a reduction in the available energy to do work on the formation, but further, creation of an outer boundary layer absent of fuel oxidizer and comprised primarily of the propellant binder, which tends to inhibit the flame spread rate because the exposed fuel oxidizer in the binder has been leached away. Furthermore, because gas generation is a function of the area of propellant burning at any given time, it is also useful to engineer a propellant fracturing system that accounts for the required initial burning surface area to provide adequate pressure rise, in addition to taking into account the flame spread rate.

In summary, the problem consists of igniting sufficient surface area of propellant simultaneously to overcome the effects of not only a limited flame spread rate, but also to mitigate the effects of any sealing coating placed on the propellant. In addition, one must be able to accurately predict the amount of gas generation by burning of the exposed surface area at any given point in time for proper modeling.

3. Solution to the Problem

The solution to the problem is to rapidly ignite the entire outer surface of the propellant charge by wrapping the ignition cord around the propellant charge in order to produce a burn that is reproducible, and can be accurately modeled to predict the resulting conditions in the well and surrounding strata during the fracturing process.

SUMMARY OF THE INVENTION

This invention provides an apparatus for fracturing wells that employs a propellant charge and an ignition cord wrapped around the outer surface of the propellant charge to rapidly ignite the outer surface of the propellant charge. For example, the ignition cord can be either a detonating cord or a deflagrating cord. The resulting rapid ignition of the outer surface of the propellant charge can be modeled more accurately and results in a more efficient use of the propellant charge in fracturing the well.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3 is a side elevational view of a propellant charge 20 with a helical groove to receive the ignition cord 30.

FIG. 4 is a cross-sectional view of an embodiment with a metal sheath 35 surrounding the ignition cord 30 and a protective coating 40 covering the entire assembly.

FIG. 5 is a side elevational view of another embodiment with the ignition cord 30 wrapped longitudinally around the propellant charge 20.

FIG. 6 is a side elevational view of a propellant charge 20 with longitudinal grooves to receive the ignition cord.

FIG. 7 is an end view of the propellant charge 20 corresponding to the FIG. 6.

DETAILED DESCRIPTION OF THE INVENTION

Figure 1:
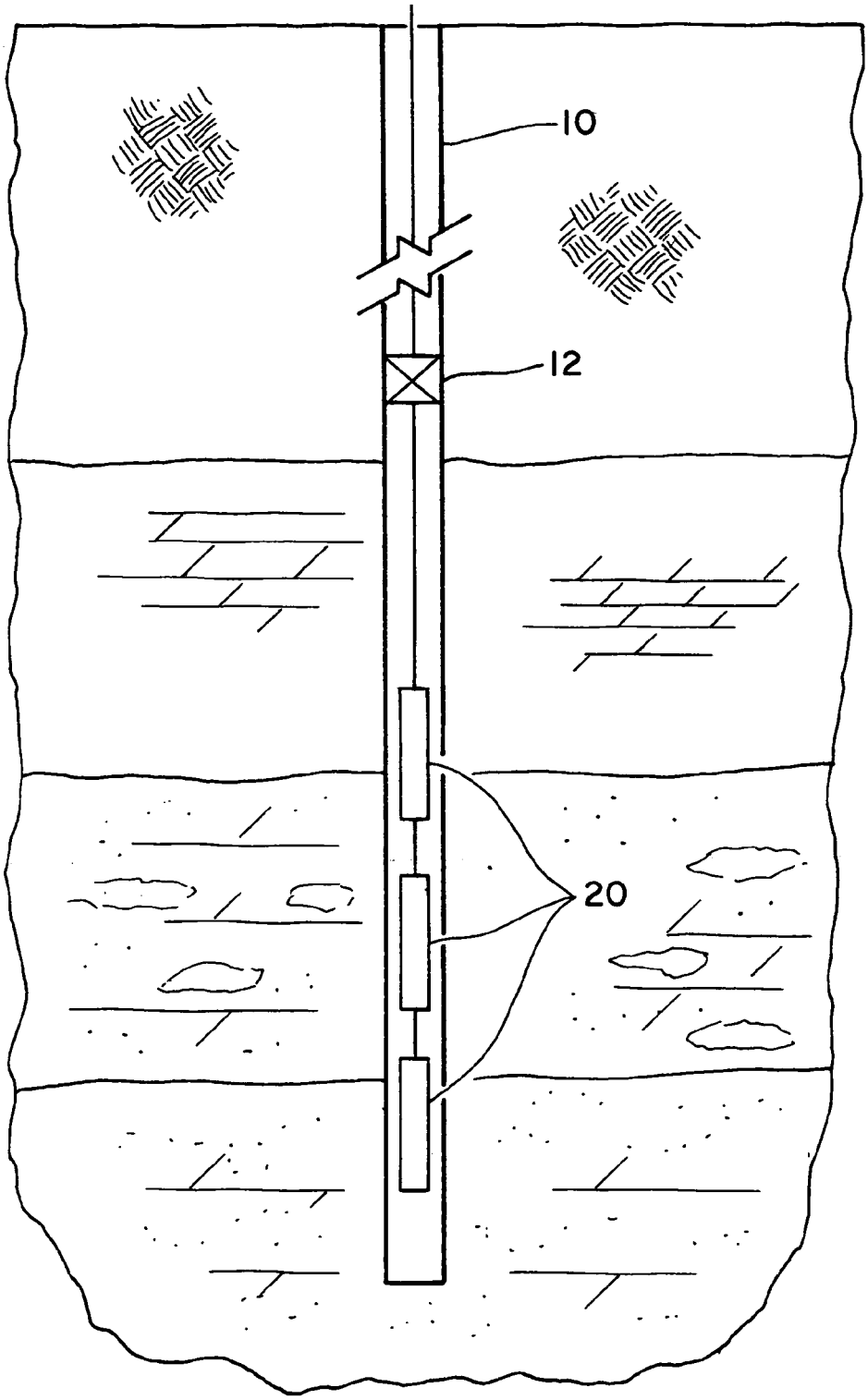
Fig. 1 ( Prior Art )
FIG. 1 is a cross-sectional diagram of a well 10 with a packer 12 and a series of propellant charges 20.
Figure 2:
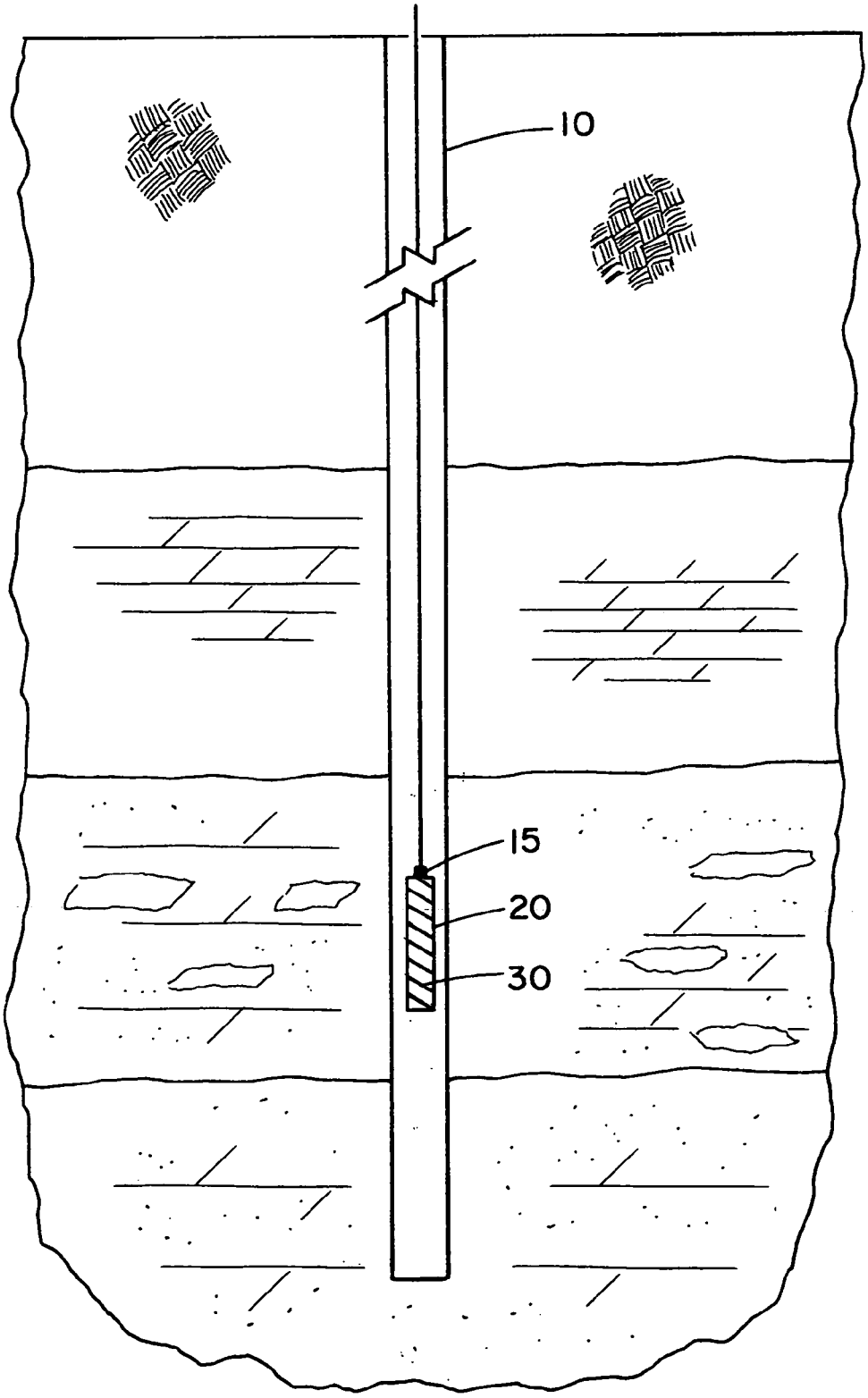
FIG. 2 is a side elevational view of a propellant charge assembly embodying the present invention.

Turning to FIG. 2, a side elevational view of a first embodiment of the present invention is shown. The outer surface of the propellant charge 20 has a generally cylindrical shape. Ignition of the outer surface of the propellant charge 20 is accomplished by an ignition cord 30 wrapped around the propellant charge 20 in a helical pattern.

Preferably, the ignition cord 30 is a high-speed mild detonating cord. The ignition cord 30 can be ignited conventionally (e.g., with an igniter patch 15). The detonating cord can either be enclosed in a metal sheath 35 (e.g., a mild steel tube designed to fail directionally toward the propellant charge 20), or placed directly in contact with the surface of the propellant 20. Mild detonating cord is also commercially available with various metal sheathes, such as lead, silver, aluminum or tin, A grain size of approximately 2.5 to 15 gr/ft has been found to be satisfactory to reliably produce a speed of about 17,000 to 22,000 ft/sec.

Alternatively a rapid deflagrating cord could be employed, although rapid deflagrating cord has a much slower speed on the order of about 1000 ft/sec. Both detonating cord and deflagrating cord should be considered as examples of the types of the ignition cords that could be used.

The pitch and/or distance between each turn of the ignition cord 30 can be modified to reduce the spacing between each adjacent turns, to thus limit or substantially eliminate the reliance on the initial flame spread rate to achieve the desired surface burning area. Thus, the amount of time required for the flame to spread becomes insignificant, and the entire surface area of the propellant charge 20 is in effect ignited simultaneously.

FIGS. 3 and 4 illustrate an embodiment in which the outer surface of the propellant charge 20 includes a helical groove 25 to receive the ignition cord 30 and substantially increase the burning surface area of the propellant charge 20. The initial surface area burning can be modified by changing the depth and/or cross-sectional geometry of the groove 25 into which the cord 30 is placed. Thus, initial gas generation rates can also be modified by the design of the groove 25. In addition, the groove 25 reduces the overall diameter of the assembly and helps to protect the cord 25 from damage.

Optionally, because the ignition cord 30 is in contact with such a large percentage of the total surface area of the propellant charge 30 and flame spread is no longer an issue, the assembly can be coated and sealed from the well bore fluids, thus helping to preventing leaching. For example, the propellant charge 20 and ignition cord 30 can be wrapped or sealed in a protective coating or layer 40, as depicted in the cross-section view depicted in FIG. 4. The protective layer 40 serves to protect both the propellant charge 20 and ignition cord 30 during transportation, handling, and insertion into the well bore, and also keeps them isolated from the well bore fluids. The assembly can be wrapped in a water tight aluminum scrim, heat shrink plastic, or other similar materials. For example, the propellant charge 20 and ignition cord 30 can be wrapped with a polymeric shrink-wrap material, such as the VITON 200 material marketed by the 3M Corporation of St. Paul, Minn.

FIGS. 5 through 7 illustrate another embodiment with the ignition cord 30 wrapped longitudinally around the propellant charge 20. FIG. 5 is a side elevational view of this embodiment. FIGS. 6 and 7 show a side elevational view and an end view, respectively, of a propellant charge 20 with longitudinal grooves to receive the ignition cord in this longitudinally-wrapped configuration. It should be understood that other wrapping configurations or combinations of wrapping configurations could be readily substituted.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. An apparatus for fracturing wells comprising:

a propellant charge for insertion into a well and having a generally cylindrical outer surface with longitudinal grooves; and an ignition cord received in the grooves and wrapped around the outer surface of the propellant charge to rapidly ignite the outer surface of the propellant charge.

2. The apparatus of claim 1 wherein the ignition cord comprises detonating cord.

3. The apparatus of claim 1 wherein the ignition cord comprises deflagrating cord.

4. The apparatus of claim 1 further comprising a protective coating covering the ignition cord and surface of the propellant charge.

5. The apparatus of claim 1 further comprising a metal sheath surrounding the ignition cord.

* * * * *